US011187237B2

(12) United States Patent
Sawada et al.

(10) Patent No.: US 11,187,237 B2
(45) Date of Patent: Nov. 30, 2021

(54) PROPELLER FAN

(71) Applicant: FUJITSU GENERAL LIMITED, Kanagawa (JP)

(72) Inventors: Hirotaka Sawada, Kanagawa (JP); Kazuya Funada, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 0 days.

(21) Appl. No.: 16/769,988

(22) PCT Filed: Dec. 5, 2018

(86) PCT No.: PCT/JP2018/044795
§ 371 (c)(1),
(2) Date: Jun. 4, 2020

(87) PCT Pub. No.: WO2019/111973
PCT Pub. Date: Jun. 13, 2019

(65) Prior Publication Data

US 2021/0199122 A1 Jul. 1, 2021

(30) Foreign Application Priority Data

Dec. 5, 2017 (JP) ..... JP2017-233659

(51) Int. Cl.
*F04D 29/32* (2006.01)
*F04D 29/28* (2006.01)

(52) U.S. Cl.
CPC ..... *F04D 29/281* (2013.01)

(58) Field of Classification Search
CPC .... F04D 29/281; F04D 29/325; F04D 29/388; F05D 2240/303; F05D 2240/304; F05D 2240/305; F05D 2240/306
See application file for complete search history.

(56) References Cited

U.S. PATENT DOCUMENTS 6,726,454 B2 * 4/2004 Blass ..... F04D 29/329 416/236 R
6,736,600 B1 5/2004 Bannasch
(Continued)

FOREIGN PATENT DOCUMENTS

CN 202833302 U 3/2013
CN 104047893 A 9/2014
(Continued)

OTHER PUBLICATIONS

Nov. 30, 2020, Chinese Office Action for related CN application No. 201880077041.7.
(Continued)

*Primary Examiner* — Ninh H. Nguyen
(74) *Attorney, Agent, or Firm* — Paratus Law Group, PLLC

(57) ABSTRACT

A propeller fan includes a hub and a plurality of blades, wherein the blade has a plurality of blade elements branching on a way from an outer peripheral portion to an inner peripheral portion, the plurality of blade elements form a hole which is a flow path for airflow, between the adjacent blade elements, have a first blade element on an upstream side and a second blade element on a downstream side to be adjacent to the first blade element which branch at a branch point, and include an extension portion as a part of the first blade element, on a trailing edge of the first blade element from the branch point to a side surface of the hub, and at least a part of a leading edge of the second blade element overlaps with a rotation orbit of the extension portion with a central axis as a rotation center.

4 Claims, 8 Drawing Sheets

(56) References Cited

U.S. PATENT DOCUMENTS

| | | | | |
|---|---|---|---|---|
| 8,240,996 | B2 * | 8/2012 | Surls | F04D 29/325 416/169 A |
| 9,447,791 | B2 * | 9/2016 | Aschermann | F04D 29/384 |
| 2004/0062654 | A1 | 4/2004 | Chang et al. | |
| 2005/0095131 | A1 | 5/2005 | Chang et al. | |
| 2005/0129518 | A1 | 6/2005 | Havel et al. | |
| 2009/0151911 | A1 | 6/2009 | De Filippis et al. | |
| 2010/0018826 | A1 * | 1/2010 | Schultheiss | F04D 29/329 192/58.4 |
| 2012/0107092 | A1 | 5/2012 | Terao | |
| 2016/0177728 | A1 | 6/2016 | Tanimitsu | |

FOREIGN PATENT DOCUMENTS

| | | | |
|---|---|---|---|
| CN | 206377068 | U | 8/2017 |
| DE | 19604638 | A1 | 8/1997 |
| DE | 102008040698 | A1 | 1/2010 |
| JP | 2003-503643 | A | 1/2003 |
| JP | 2004-116511 | A | 4/2004 |
| JP | 2010-101223 | A | 5/2010 |
| KR | 2001-0063069 | A | 7/2001 |
| WO | WO 2011/001890 | A1 | 1/2011 |
| WO | WO 2014/142443 | A1 | 9/2014 |
| WO | WO 2015/072256 | A1 | 5/2015 |

OTHER PUBLICATIONS

Aug. 6, 2021, European Search Report issued for related EP application No. 18885012.7.

* cited by examiner

PROPELLER FAN

CROSS REFERENCE TO PRIOR APPLICATION

This application is a National Stage Patent Application of PCT International Patent Application No. PCT/JP2018/044795 (filed on Dec. 5, 2018) under 35 U.S.C. § 371, which claims priority to Japanese Patent Application No. 2017-233659 (filed on Dec. 5, 2017), which are all hereby incorporated by reference in their entirety.

FIELD

The present invention relates to a propeller fan.

BACKGROUND

An outdoor unit of an air conditioner has a propeller fan inside. The wind speed of the propeller fan is high at the outer peripheral portion of the blade, and the wind speed decreases toward the rotation center. In recent years, in order to improve the energy-saving performance of an air conditioner, the air volume of a propeller fan has been increased, the diameter of the propeller fan has been increased, and the speed of the propeller fan has been increased. CITATION LIST Patent Literature Patent Literature 1: Japanese Laid-open Patent Publication No. 2010-101223A Patent Literature 2: International Patent Publication WO2011/001890

Patent Literature 3: Japanese Translation of PCT International Application Publication No. JP-T-2003-503643

Patent Literature 4: Japanese Laid-open Patent Publication No. 2004-116511A

SUMMARY

Technical Problem

However, the above-described related art has the following problem. That is, the distribution of the wind speed in a radial direction becomes non-uniform, and a surging phenomenon such as suction of air from the downstream side occurs in the inner peripheral portion of the blade, result ng in an abnormal operation state. In a case where a propeller fan is used for an outdoor unit, if a surging phenomenon occurs, noise or damage to the propeller fan may occur. In addition, since the inner peripheral portion where the wind speed is low does not contribute to the air blowing, the amount of air blowing is small for the size, and the airflow is easily disturbed, so that it can be said that the blade surface is not effectively used.

The present invention has been made in view of the above problems, and an object of the invention is to provide a propeller fan which can increase the air volume of the propeller fan while suppressing the occurrence of a surging phenomenon.

Solution to Problem

A propeller fan of the disclosure includes a hub having a side surface around a central axis, and a plurality of blades provided to the side surface, wherein the blade has an inner peripheral portion positioned on the base side in a portion from a base connected to the hub to an outer periphery and an outer peripheral portion positioned on the outer peripheral side, and has a plurality of blade elements branching on a way from the outer peripheral portion to the inner peripheral portion, the plurality of blade elements have a trailing edge on a downstream side of rotation with the central axis as a rotation center, and a leading edge on an upstream side of the rotation, are connected to the side surface at a pitch angle with respect to the central axis, and form a hole which is a flow path for airflow, between the adjacent blade elements, the plurality of blade elements have a first blade element on the upstream side of the rotation and a second blade element on the downstream side of the rotation to be adjacent to the first blade element which branch at a branch point on the way from the outer peripheral portion to the inner peripheral portion, and include an extension portion as a part of the first blade element, on the trailing edge of the first blade element from the branch point to the side surface, and at least a part of the leading edge of the second blade element overlaps with a rotation orbit of the extension portion with the central axis as the rotation center.

Advantageous Effects of Invention

According to the present invention, for example, at is possible to increase the air volume of a propeller fan while suppressing the occurrence of a surging phenomenon.

DESCRIPTION OF EMBODIMENTS

Figure 1:
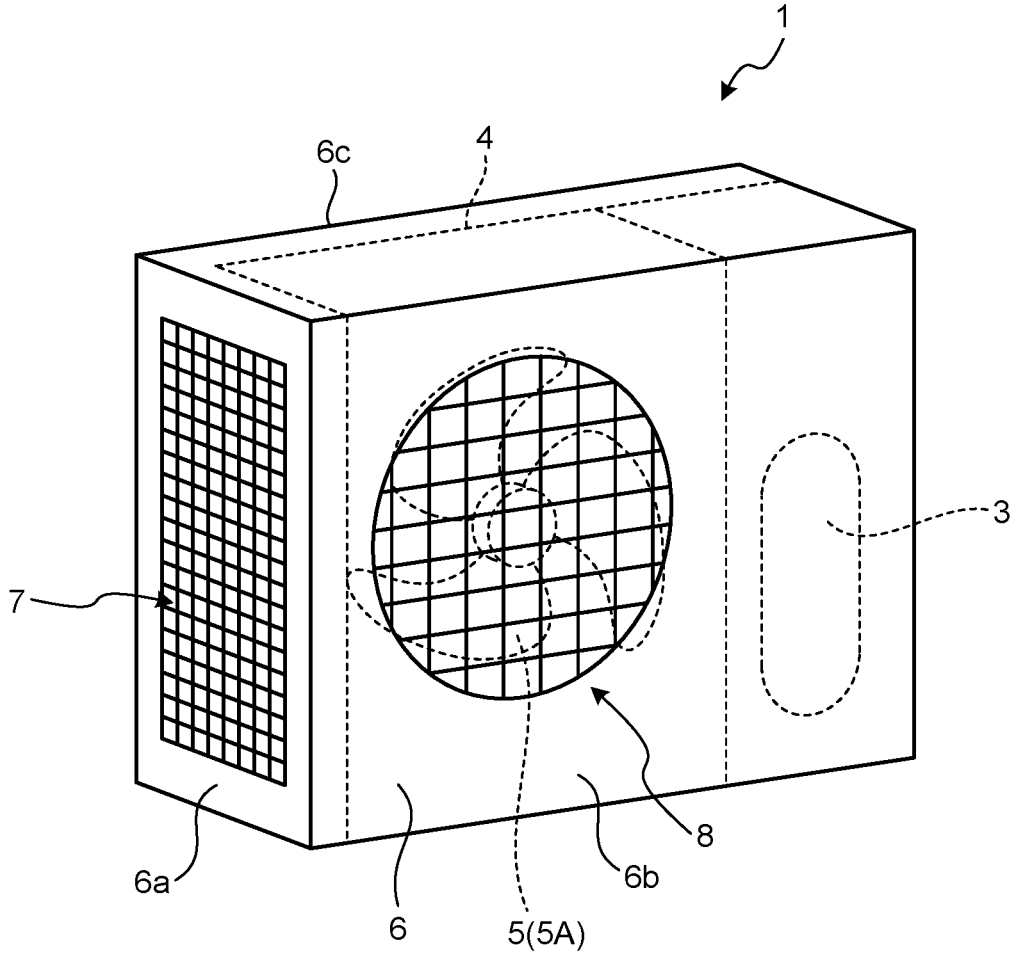
FIG. 1 is a schematic diagram illustrating an outdoor unit having a propeller fan according to a first embodiment.

Hereinafter, embodiments for carrying out the present invention will be described in detail with reference to the drawings. The embodiments disclosed below do not limit the technology disclosed in the present application. In addition, the embodiments and modifications described below may be appropriately combined and implemented within a range not inconsistent. Note that the same or similar elements will be denoted by the same reference numerals and description thereof will be omitted below.

FIRST EMBODIMENT

Configuration of Outdoor Unit

FIG. 1 is a schematic diagram illustrating an outdoor unit having a propeller fan according to a first embodiment. As illustrated in FIG. 1, an outdoor unit 1 of the first embodiment is an outdoor unit of an air conditioner. The outdoor unit 1 has a housing 6, and accommodates a compressor 3 that compresses a refrigerant, a heat exchanger 4 which is connected to the compressor 3 and through which the refrigerant flows, and a propeller fan 5 that blows air to the heat exchanger 4, in the housing 6.

The housing 6 has an inlet 7 for taking in outside air and an outlet 8 for discharging air inside the housing 6. The inlet 7 is provided on a side surface 6*a* and a rear surface 6*c* of the housing 6. The outlet 8 provided on a front surface 6*b* of the housing 6. The heat exchanger 4 is disposed from the rear surface 6*c* facing the front surface 6*b* of the housing 6 to the side surface 6*a*. The propeller fan 5 is disposed to face the outlet 8, and is driven to rotate by a fan motor (not illustrated). In the following description, the direction of the wind discharged from the outlet 8 by the rotation of the propeller fan 5 is defined as a positive pressure side, and the direction of the wind opposite thereto is defined as a negative pressure side.

Propeller Fan According to First Embodiment

Figure 2:
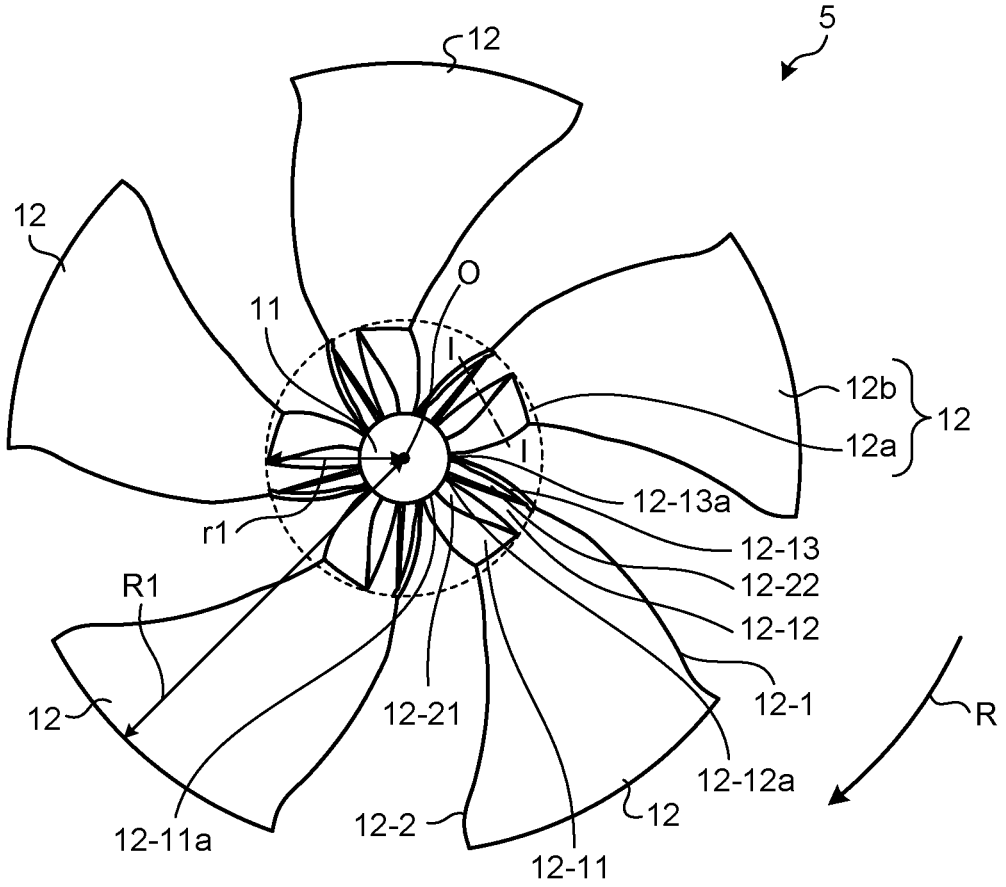
FIG. 2 is a schematic plan view of the propeller fan according to the first embodiment as viewed from a positive pressure side.
Figure 3:
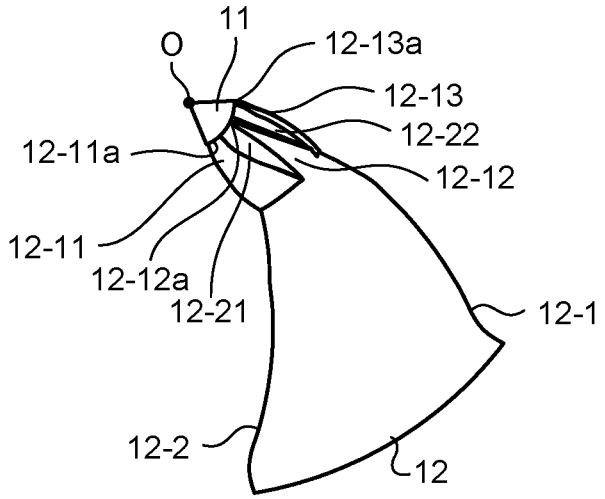
FIG. 3 is a plan view of one of blades of the propeller fan according to the first embodiment as viewed from the positive pressure side.
Figure 4:
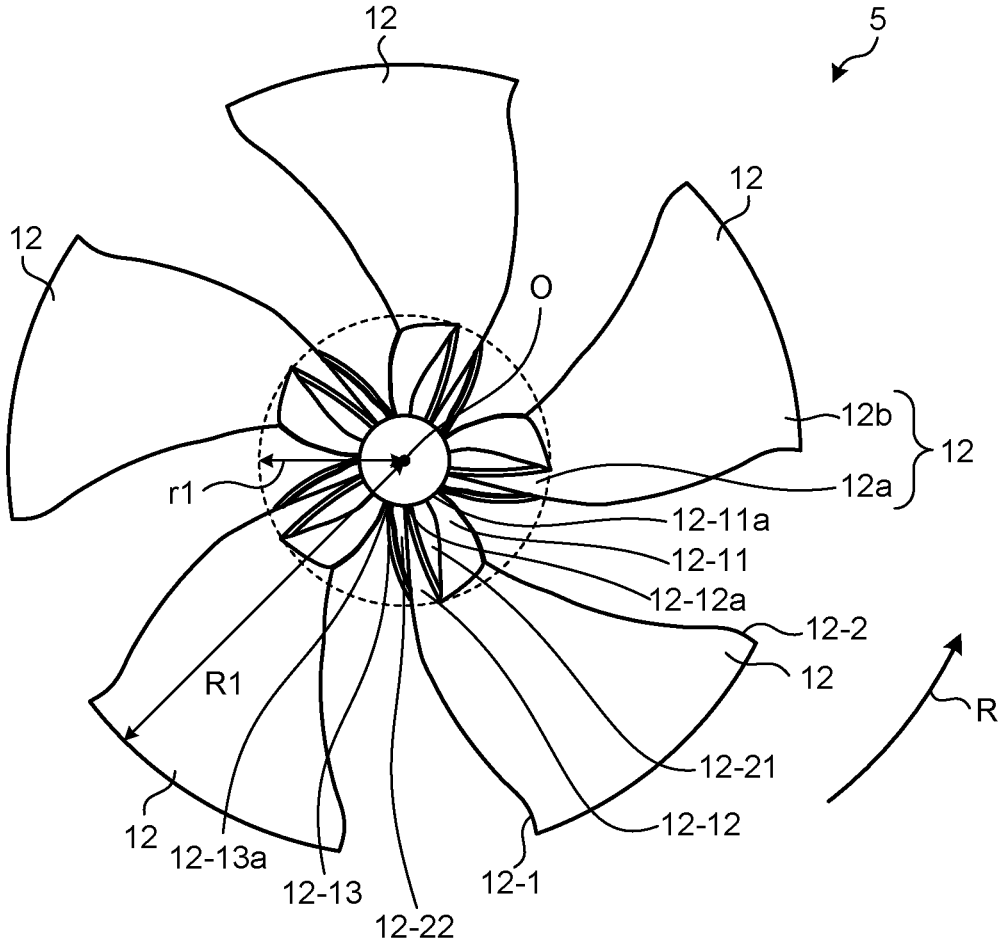
FIG. 4 is a schematic plan view of the propeller fan according to the first embodiment as viewed from a negative pressure side.
Figure 5:
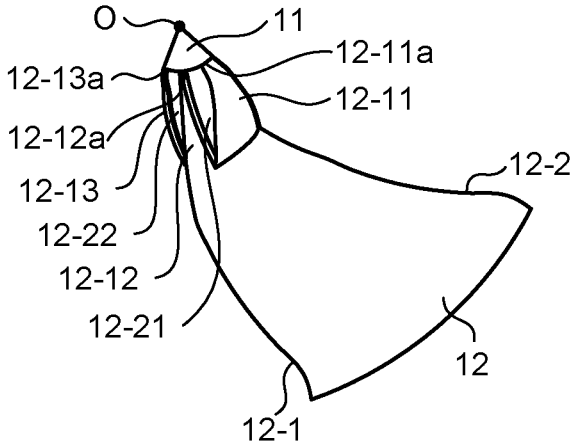
FIG. 5 is a plan view of one of the blades of the propeller fan according to the first embodiment as viewed from the negative pressure side.
Figure 6:
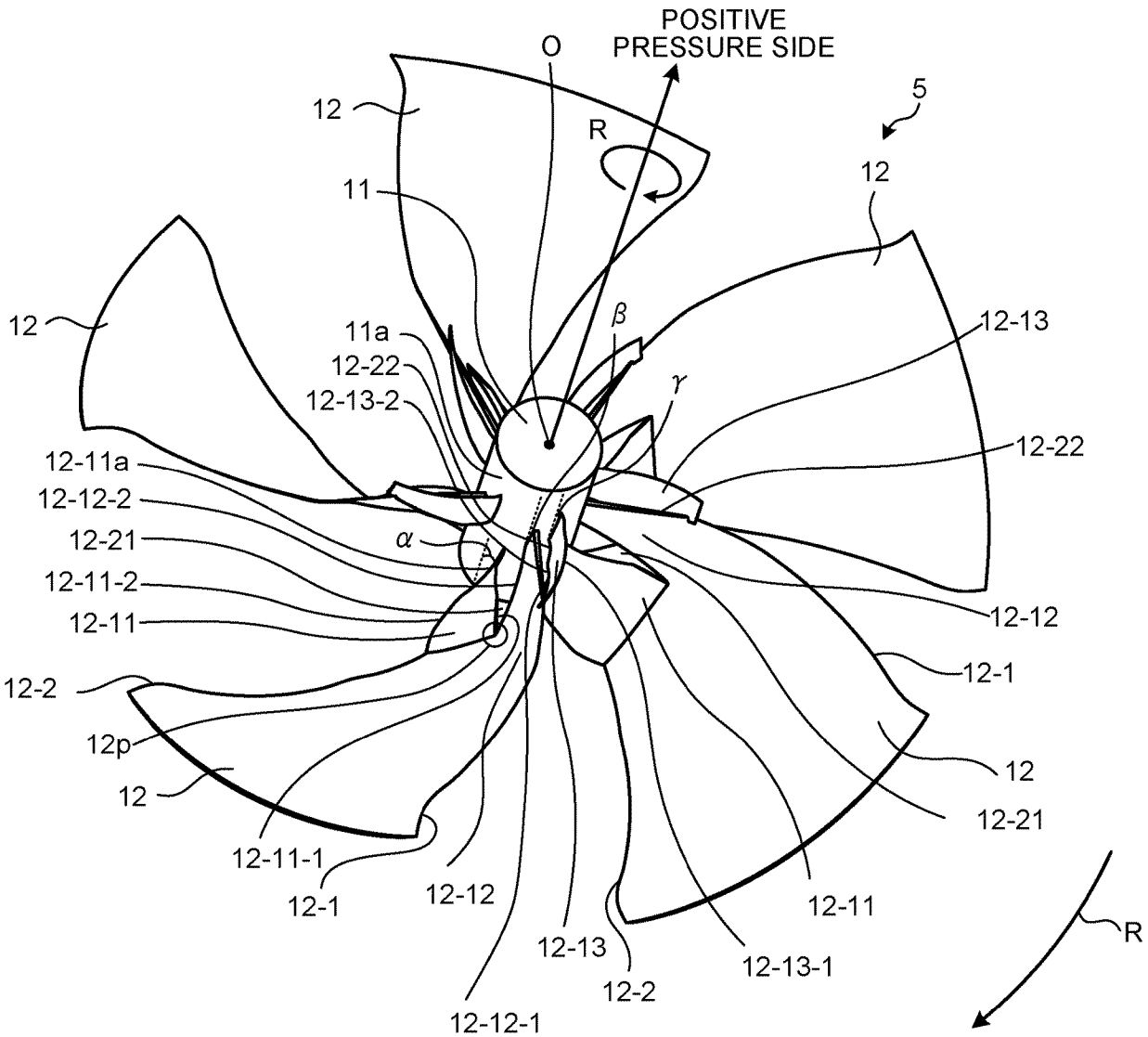
FIG. 6 is a perspective view of the propeller fan according to the first embodiment.
Figure 7:
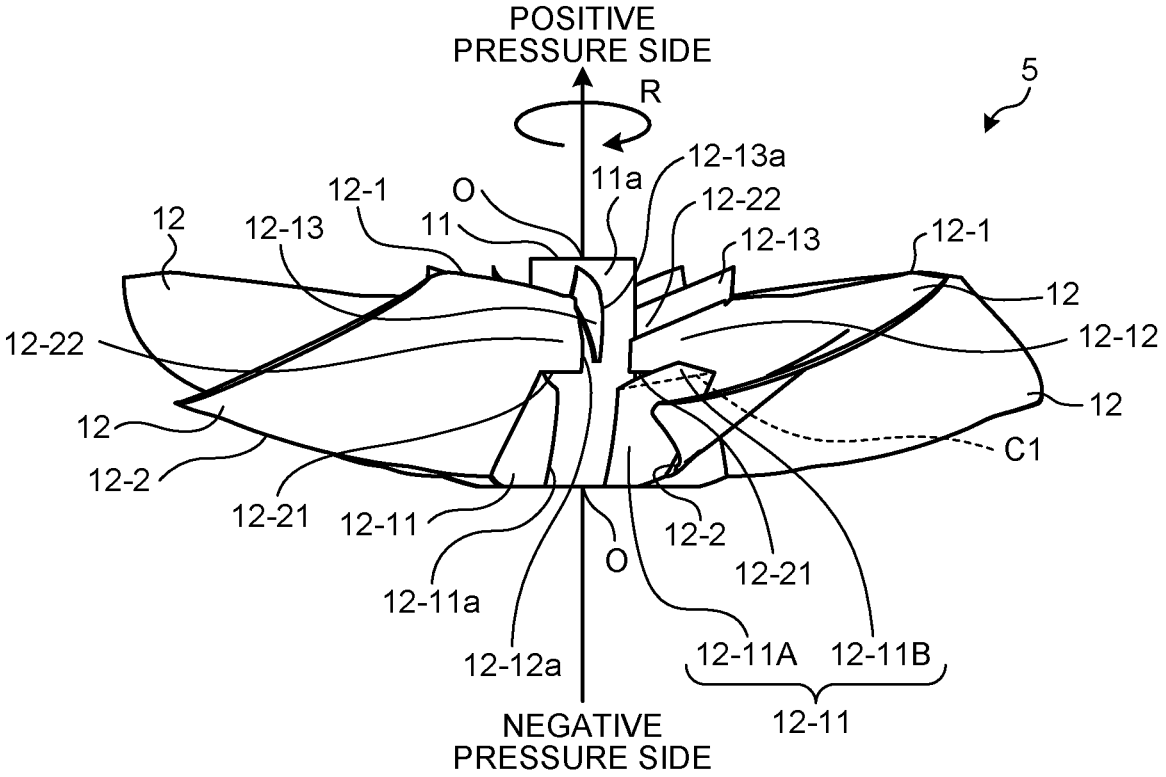
FIG. 7 is a side view illustrating the propeller fan according to the first embodiment.
Figure 8:
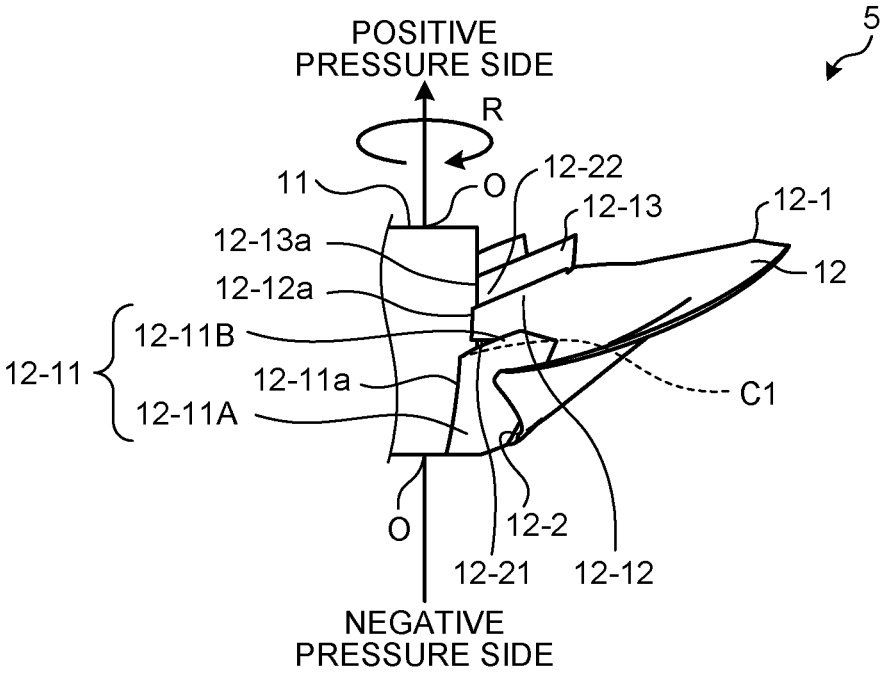
FIG. 8 is a side view illustrating one of the blades of the propeller fan according to the first embodiment.

FIG. 2 is a schematic plan view of the propeller fan according to the first embodiment as viewed from the positive pressure side. FIG. 3 is a plan view of one of blades of the propeller fan according to the first embodiment as viewed from the positive pressure side. FIG. 4 is a schematic plan view of the propeller fan according to the first embodiment as viewed from the negative pressure side. FIG. 5 is a plan view of one of the blades of the propeller fan according to the first embodiment as viewed from the negative pressure side. FIG. 6 is a perspective view of the propeller fan according to the first embodiment. FIG. 7 is a side view illustrating the propeller fan according to the first embodiment. FIG. 8 is a side view illustrating one of the blades of the propeller fan according to the first embodiment.

As illustrated in FIGS. 2 to 8, the propeller fan 5 according to the first embodiment includes a hub 11 formed in a cylindrical shape (or a polygonal pillar shape) in appearance, and a plurality of blades 12 provided on a side surface 11*a* (refer to FIGS. 6 and 7) of the hub 11, the side surface 11*a* being provided around a central axis of the hub 11. The hub 11 and the plurality of blades 12 are integrally formed using, for example, a resin material as a molding material. The blade 12 has a leading edge 12-2 that is a front side of the blade 12 in a rotational direction, and a trailing edge 12-1 that is a rear side of the blade 12 in the rotational direction. The leading edge 12-2 is formed to be curved so as to be concave toward the trailing edge 12-1 positioned on the opposite side of the leading edge 12-2. The blade is also called a wing.

The hub 11 has a boss (not illustrated) into which a shaft (not illustrated) of a fan motor is fitted, at a position of a central axis O of the hub 11 at the end of the propeller fan 5 on the negative pressure side (refer to FIGS. 4 and 7). The hub 11 is rotated in a direction of "R" illustrated in FIGS. 2, 4, and 6 to 8, around the central axis C) of the hub 11 with the rotation of the fan motor. The plurality of (five in the example of FIGS. 2 to 8) blades 12 are integrally formed on the side surface 11*a* of the hub 11 at predetermined intervals along a circumferential direction of the hub 11. The blade 12 formed in a curved plate shape.

In the plan view illustrated in FIGS. 2 and 4, the propeller fan 5 has an inner peripheral portion 12*a* of 313 the blade 12 which is positioned within the circumference of a circle having a radius r1 from the central axis O, and an outer peripheral portion 12*b* of the blade 12 which is positioned outside the circle having the radius r1 from the central axis O and within the circle having a radius R1 from the central axis O. As illustrated in FIGS. 2 and 4, the outer peripheral portion 12*b* extending in the radial direction of the hub 11 has a larger blade area than the inner peripheral portion 12*a* connected to the hub 11.

In the plan view illustrated in FIGS. 2 and 4, the propeller fan 5 has blade elements 12-11, 12-12, and 12-13 on the inner peripheral portion 12*a* of each of the blades 12. The blade element 12-11 is an example of a first blade element, and the blade element 12-12 is an example of a second blade element.

The size relationship of the blade areas of the blade elements 12-11, 12-12, and 12-13 can be appropriately changed in design, and the blade area of the blade element 12-11 may be the largest as compared with the blade areas of the blade elements 12-12 and 12-13.

In the plan view illustrated in FIGS. 2 and 4, the propeller fan 5 has a hole 12-21 between the blade elements 12-11 and 12-12 of the inner peripheral portion 12*a* of each of the blades 12, and a hole 12-22 between the blade elements 12-12 and 12-13 of the inner peripheral portion 12*a* of each of the blades 12. The hole 12-21 is provided to be in contact with the boundary between the inner peripheral portion 12*a* and the outer peripheral portion. 12*b* (position at the radius r1 from the central axis O). The holes 12-21 and 12-22 are flow paths for the airflow.

That is, each of the blades 12 is connected to the hub 11 such that a base 12-11*a* of the blade element 12-11 and a base 12-12*a* of the blade element 12-12 form the hole 12-21 in the inner peripheral portion 12*a*. Further, each of the blades 12 is connected to the hub 11 such that the base 12-12*a* of the blade element 12-12 and a base 12-13*a* of the blade element 12-13 form the hole 12-22 in the inner peripheral portion 12*a*. In each of the blades 12, the outer peripheral portion 12*b* is continuous with the blade elements 12-11, 12-12, and 12-13, and the inner peripheral portion 12*a* and the outer peripheral portion 12*b* form one blade surface.

In other words, the three blade elements 12-11, 12-12, and 12-13 branch on the way from the outer peripheral portion 12*b* to the inner peripheral portion 12*a* of the blade 12. The hole 12-21 between the blade elements 12-11 and 12-12 and the hole 12-22 between the blade elements 12-12 and 12-13 serve as flow paths for the airflow passing through the propeller fan 5, respectively.

As illustrated in FIGS. 2 to 8, the blade element 12-11 of the blade 12 is connected to the hub 11 with the base 12-11*a* as a connection part. The blade element 12-12 of the blade 12 is connected to the hub 11 with the base 12-12*a* as a connection part. The blade element 12-13 of the blade 12 is connected to the hub 11 with the base 12-13*a* as a connection part.

In addition, in the blade 12 the blade element 12-12 positioned on the downstream side (trailing edge side) of the airflow is connected to the hub 11 on the positive pressure side with respect to the blade element 12-11 positioned on the upstream side (leading edge side). The hole 12-21 of the blade 12 is positioned between the blade element 12-12 and the blade element 12-11 in the central axis O direction and the circumferential direction.

In addition, in the blade 12 the blade element 12-13 positioned on the downstream side (trailing edge side) of the airflow is connected to the hub 11 on the positive pressure side with respect to the blade element 12-12 positioned on the upstream side (leading edge side). The hole 12-22 of the blade 12 is positioned between the blade elements 12-13 and 12-12 in the central axis O direction and the circumferential direction.

The number of blade elements 12-11, 12-12, and 12-13 of the blade 12 and the number of holes 12-21 and 12-22 of the blade 12 in the first embodiment are not limited to those illustrated in FIGS. 2 to 8. One hole may be provided for two blade elements, or holes of which the number is (the number of blade elements—1) may be provided for four or more blade elements.

Further, as illustrated in FIG. 6, the blade element 12-11 has a leading edge 12-11-2 on the upstream side (leading edge side) in the rotational direction ("R" direction in the drawing), and a trailing edge 12-11-1 on the downstream side (trailing edge side) in the rotational direction ("R" direction in the drawing). The blade element 12-12 has a leading edge 12-12-2 on the upstream side (leading edge side) in the rotational direction ("R" direction in the drawing), and a trailing edge 12-12-1 on the downstream side (trailing edge side) in the rotational direction ("R" direction in the drawing). The blade element 12-13 has a leading edge 12-13-2 on the upstream side (leading edge side) in the rotational direction ("R" direction in the drawing), and a trailing edge 12-13-1 on the downstream side (trailing edge side) in the rotational direction ("R" direction in the drawing).

As illustrated in FIGS. 7 and 8, in the blade 12, the blade element 12-11 has a base portion 12-11A and an extension portion 12-11B which are defined by a boundary C1. The boundary C1 has a positional relationship substantially parallel to the leading edge 12-12-2 of the blade element 12-12. As illustrated in FIGS. 7 and 8, the boundary C1 has one end corresponding to a branch point 12*p* of the blade element 12-11 and the blade element 12-12 which branch on the way from the outer peripheral portion 12*b* to the inner peripheral portion 12*a* of the blade 12, and the other end corresponding to an end point of the base 12-11*a* on the positive pressure side.

As illustrated in FIGS. 7 and 8, the extension portion 12-11B is a portion further extending from the base portion 12-11A of the blade element 12-11 toward the hole 12-21 present between the blade element 12-11 and the blade element 12-12, to the downstream side of the airflow. In the side view illustrated in FIGS. 7 and 8, the extension portion 12-11B has a triangular or convex shape having the boundary C1 as the base and both ends of the boundary C1 as vertices of base angles.

In the side view illustrated in FIGS. 7 and 8, the extension portion 12-11B has a triangular or convex shape. From this, a part of the hole 12-21 is shielded from the airflow along the blade element 12-11 near the branch point 12*p* of the blade element 12-11 and the blade element 12-12. The remaining unshielded part of the hole 12-21 is exposed to the airflow along the blade element 12-11 near the side surface 11*a* of the hub 11.

In other words, the extension portion 12-11B has a portion which overlaps with the blade element 12-12 in the rotational direction ("R" direction in the drawing), in the vicinity of the branch point 12*p* of the blade element 12-11 and the blade element 12-12, and a portion which does not overlap with the blade element 12-12 in the rotational direction. ("R" direction in the drawing), in the vicinity of the base 12-11*a* of the blade element 12-11. The blade element 12-11 has the extension portion 12-11B that overlaps with the blade element 12-12 in the rotational direction ("R" direction in the drawing) at least in the vicinity of the branch point 12*p* of the blade element 12-11 and the blade element 12-12.

That is, the extension portion 12-11B has a shape in which the height of the extension portion 12-11B from the boundary C1 in the positive pressure side of the hub 11 gradually increases from the one end of the boundary C1 in the vicinity of the branch point 12*p* of the blade element 12-11 and the blade element 12-12, and the height thereof from the boundary C1 in the positive pressure side of the hub 11 decreases after a point where the extension portion 12-11B be highest from the boundary C1 in the positive pressure side of the hub 11 to reach the other end of the boundary C1.

The extension portion 12-11B has a shape in which the height of the extension portion 12-11B from the boundary C1 in the positive pressure side of the hub 11 gradually increases, in the vicinity of the branch point 12*p* of the blade element 12-11 and the blade element 12-12. In other words, the extension portion 12-11B has a portion having a shape that allows the airflow flowing along the blade surfaces of the blade element 12-11 and the blade element 12-12 to escape to the hole 12-21, at the branch point 12*p* of the blade element 12-11 and the blade element 12-12. Therefore, since the outer end of the extension portion 12-11B is positioned at the branch point 12*p*, during the operation of the air conditioner with a high load or at a high speed, the airflow flowing from the hole 12-21 along the blade surface of the blade element 12-12 (airflow inclined in the radial direction due to the influence of centrifugal force in particular) is less likely to become a ventilation resistance, and part of this airflow escapes to the hole 12-21 so that the load on the outer peripheral blade surface of the blade element 12-12 is reduced and an increase in input power supplied to the fan motor (not illustrated) to drive the propeller fan 5 can be suppressed.

In addition, since the airflow along the blade element 12-11 moves in the outer circumferential direction due to centrifugal force by the rotation of the propeller fan 5, even if the extension portion 12-11B only overlaps with the blade element 12-12 in the rotational direction ("R" direction in the drawing) at least in the vicinity of the branch portion of the blade element 12-11 and the blade element 12-12, the number of blades on the inner peripheral side is increased to increase the wind speed of the inner peripheral portion, and thus it is possible to suppress the occurrence of an abnormal operation state such as a turbulence in airflow or a surging phenomenon caused by the difference in wind speed between the outer peripheral portion and the inner peripheral portion, and to increase the air volume. This becomes more remarkable in a case where the blade element 12-12 has the same extension portion as the extension portion 12-11B. That is, since the airflow along the blade elements 12-11, 12-12, and 12-13 moves in the outer circumferential direction due to centrifugal force by the rotation of the propeller fan 5, it is possible to expect an increase in air volume by providing the extension portion in the outer circumferential direction of at least the blade elements 12-11, 12-12, and 12-13.

Outline of I-I Cross Section of Propeller Fan According to First Embodiment

Figure 9:
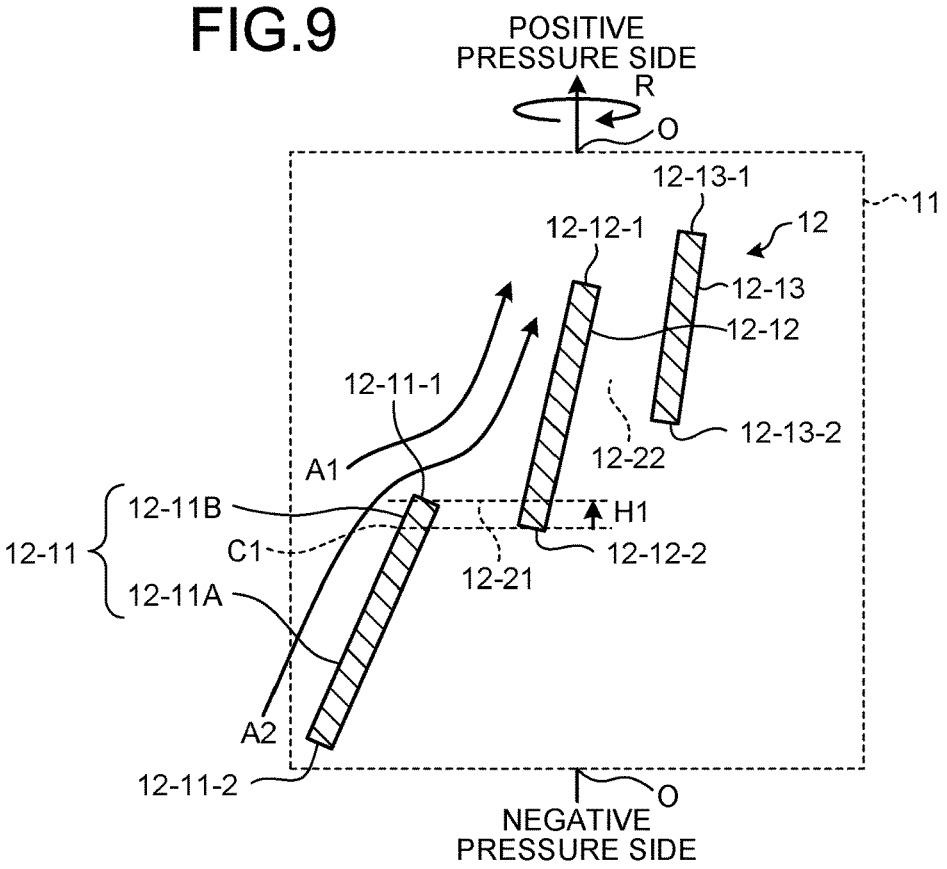
FIG. 9 is a cross-sectional view illustrating an outline of an I-I cross section of the propeller fan according to the first embodiment.

Further, a positional relationship between the blade element 12-11 and the blade element 12-12 which are adjacent to each other will be described with reference to FIG. 9. FIG. 9 is a cross-sectional view illustrating an outline of the I-I cross section of the propeller fan according to the first embodiment. Here, the I-I cross section is a cross section when the blade 12 of the propeller fan 5 is cut along a cutting line I-I in the plan view of the propeller fan 5 in FIG. 2 and viewed from the outer peripheral portion 12*b* side.

The blade 12 has the blade elements 12-11, 12-12, and 12-13. The blade elements 12-11, 12-12, and 12-13 partially overlap with one another when viewed in the rotational direction ("R" direction in the drawing) in order of the blade elements 12-11, 12-12, and 12-13 from the upstream side (leading edge side) in the rotational direction ("R" direction in the drawing).

Specifically, as illustrated in FIG. 9, the blade 12 has the extension portion 12-11B, which partially overlaps with the leading edge 12-12-2 of the blade element 12-12 when viewed in the rotational direction ("R" direction in the drawing), on the trailing edge 12-11-1 side of the blade element 12-11. The portion of the extension portion 12-11B partially overlapping with the leading edge 12-12-2 of the blade element 12-12 when viewed in the rotational direction ("R" direction in the drawing) has the highest height of H1 from the boundary C1 in the positive pressure direction in the axial direction of the hub 11.

Pitch angles α, β, and γ of the blade elements 12-11, 12-12, and 12-13 with respect to the central axis O of the hub 11 can be appropriately changed in design, and the pitch angle α of the blade element 12-11 may be the largest as compared with the pitch angles β and γ of the blade elements 12-12 and 12-13.

Further, as can be seen from FIGS. 2 to 9, in the blade 12, the blade elements 12-11, 12-12, and 12-13 do not overlap in the direction of the central axis O on the side surface 11*a* of the hub 11. The blade elements 12-11, 12-12, and 12-13 are connected to the position of the side surface 11*a* of the hub 11 so as not to overlap in the direction of the central axis O on the side surface 11*a* of the hub 11.

In the blade 12, the blade elements 12-11, 12-12, and 12-13 may overlap in the direction of the central axis O of the hub 11. That is, the blade elements 12-11, 12-12, and 12-13 may be connected to the side surface 11*a* of the hub 11 such that the bases 12-11*a*, 12-12*a*, and 12-13*a* are aligned substantially on a straight line on the side surface of the hub 11.

As illustrated in FIG. 9, the extension portion 12-11B partially overlaps the blade element 12-12 in the rotational direction ("R" direction in the drawing). In other words, a part of the leading edge 12-12-2 of the blade element 12-12 overlaps with a rotation orbit of the extension portion 12-11B with the hub 11 as the rotation center. That is, the extension portion 12-11B overlaps a part of the leading edge 12-12-2 of the blade element 12-12 along an airflow A2 flowing from the upstream side to the downstream side in the rotational direction ("R" direction in the drawing) with the rotation of the blade 12. From this, both the airflows A1 and A2 flowing from the upstream side to the downstream side in the rotational direction ("R" direction in the drawing) with the rotation of the blade 12 flow along the blade surfaces from the upstream side to the downstream side of the blade surfaces of the blade elements 12-11 and 12-12. That is, since the airflow A2 having flowed along the blade surface of the blade element 12-11 continues to flow along the blade surface of the blade element 12-12 without flowing into the hole 12-21 present between the blade element 12-11 and the blade element 12-12, there is no loss of air volume.

Further, the blade elements 12-12 and 12-13 are arranged to overlap with the rotation orbits of the blade elements 12-11 and 12-12 with the hub 11 as the rotation center. By arranging the blade elements 12-12 and 12-13 to overlap with the rotation orbits of the blade elements 12-11 and 12-12 with the hub 11 as the rotation center, the airflow flowing along the position of the blade surface separated from the extension portion 12-11B can be affected by the next blade elements 12-12 and 12-13.

Figure 10:
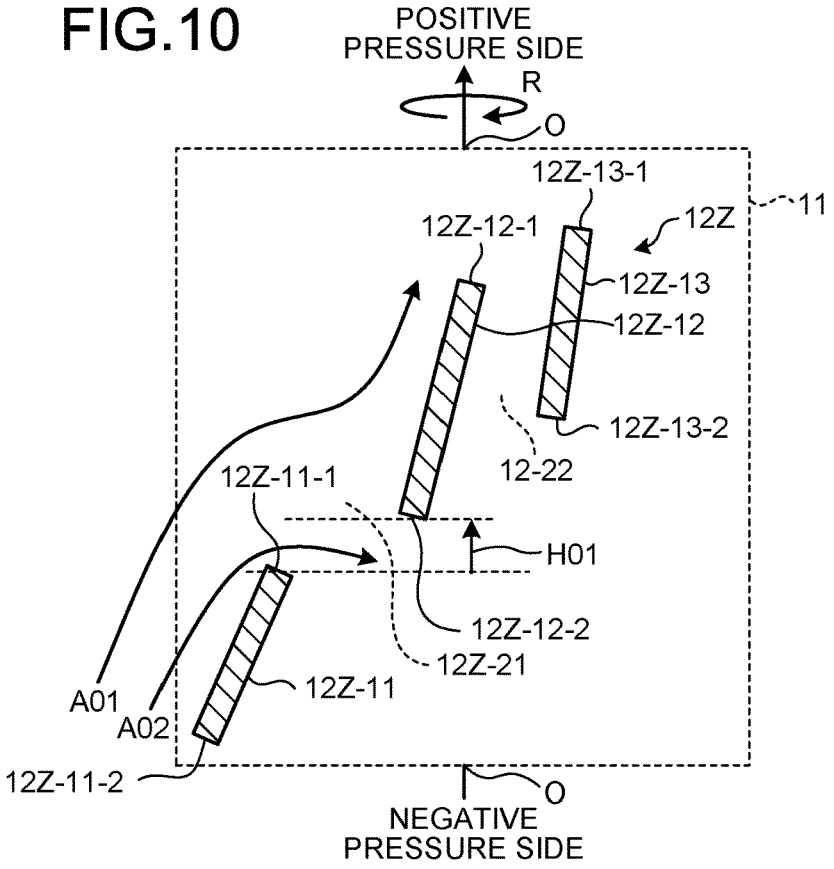
FIG. 10 is a cross-sectional view for comparing a propeller fan according to a comparative example with the propeller fan according to the first embodiment in the I-I cross section.

Outline of I-I Cross Section of Propeller Fan According to Comparative Example FIG. 10 is a cross-sectional view for comparing a propeller fan according to a comparative example with the propeller fan according to the first embodiment in the I-I cross section. FIG. 10 is a cross-sectional view of a blade 12Z of a propeller fan according to the comparative example when viewed along the same I-I cross section (not illustrated) as the I-I cross section of the propeller fan 5 according to the first embodiment in FIG. 2.

The blade 12Z has blade elements 12Z-11, 12Z-12, and 12Z-13. The blade elements 12Z-11, 12Z-12, and 12Z-13 do not overlap with one another when viewed in the rotational direction ("R" direction in the drawing) in order of the blade elements 12Z-11, 12Z-12, and 12Z-13 from the upstream side (leading edge side) in the rotational direction ("R" direction in the drawing).

Specifically, as illustrated in FIG. 10, the blade 12Z does not have a portion partially overlapping with a leading edge 12Z-12-2 of the blade element 12Z-12 in the rotational direction ("R" direction in the drawing), on a trailing edge 12Z-11-1 side of the blade element 12Z-11. The interval between the trailing edge 12Z-11-1 of the blade element 12Z-11 and the leading edge 12Z-12-2 of the blade element 12Z-12 is H01 at the widest part in the axial direction of the hub 11.

For this reason, in the blade 12Z of the propeller fan according to the comparative example, since an airflow A02 is sandwiched between the blade elements 12Z-11 and 12Z-12, an airflow A01 flowing from the upstream side to the downstream side in the rotational direction ("R" direction in the drawing) with the rotation of the blade 12Z flows along the blade surfaces on the downstream side of the blade elements 12Z-11 and 12Z-12. However, since the airflow A02 flowing from the upstream side to the downstream side in the rotational direction ("R" direction in the drawing) with the rotation of the blade 12Z directly follows the blade surfaces of the blade elements 12Z-11 and 12Z-12, the airflow A02 flows into a hole 12Z-21 present between the blade element 12Z-11 and the blade element 12Z-12 without flowing along the blade surface of the blade element 12Z-12 after flowing along the blade surface on the downstream side of the blade element 12Z-11. For this reason, the airflow A02 flowing into the hole 12Z-21 present between the blade element 12Z-11 and the blade element 12Z-12 becomes a loss of air volume as compared with the first embodiment.

Figure 11:
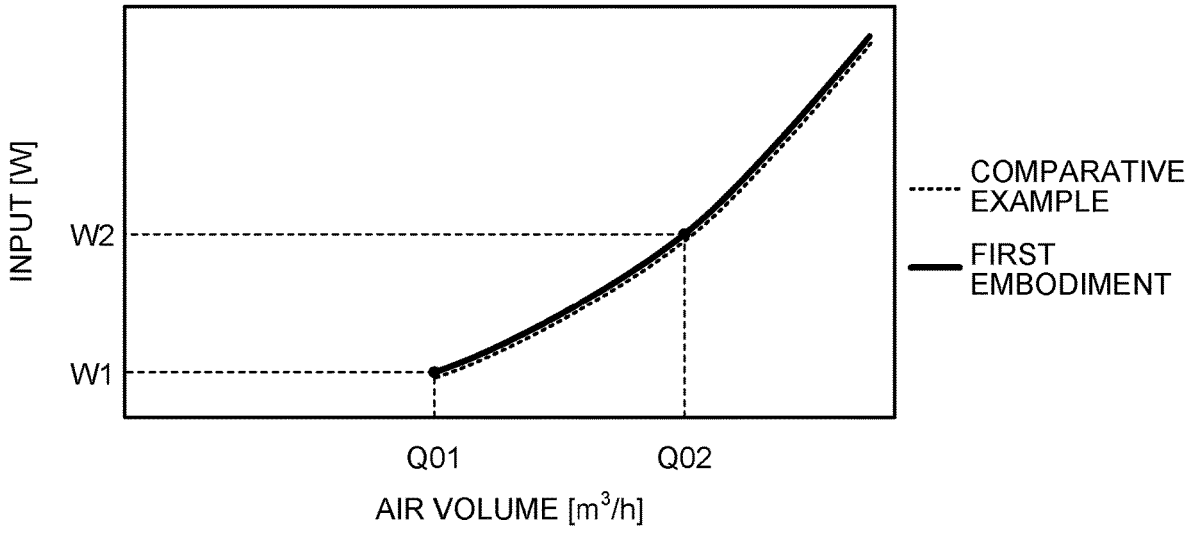
FIG. 11 is an air volume-input (input power) curve diagram.
Figure 12:
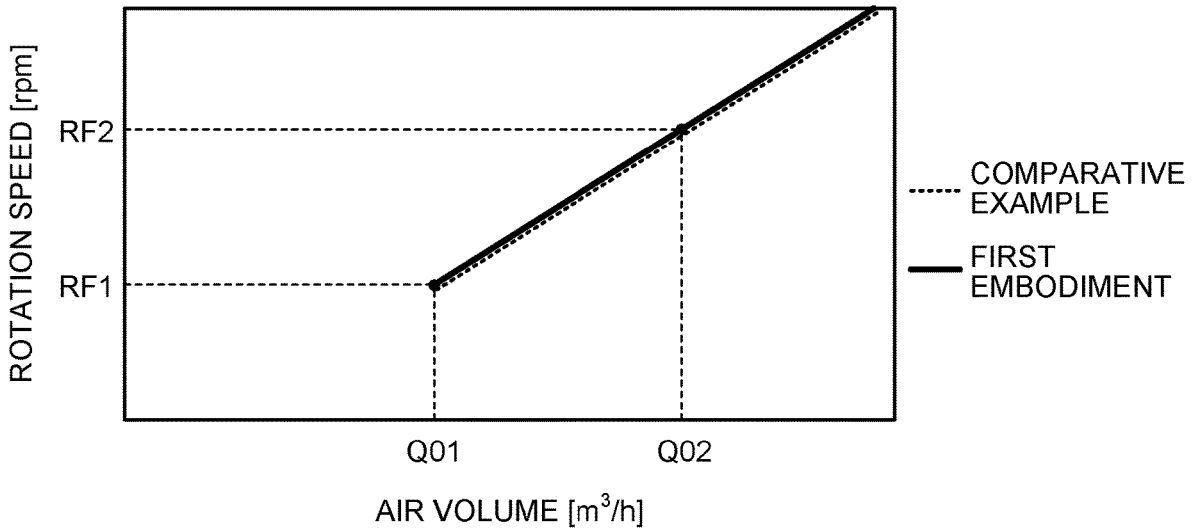
FIG. 12 is an air volume-rotation speed curve diagram.
Figure 13:
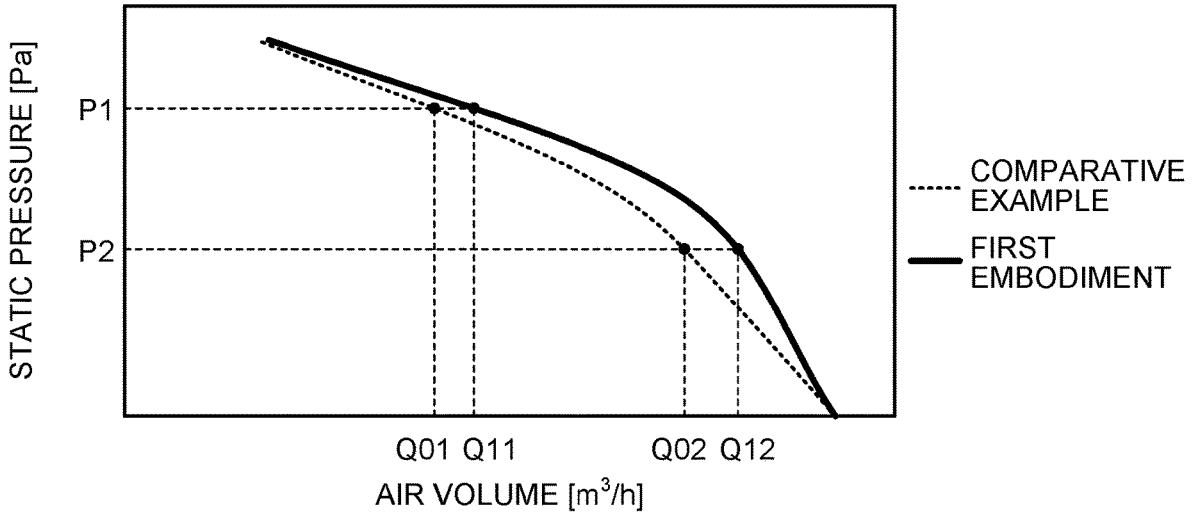
FIG. 13 is an air volume-static pressure curve diagram.

Comparison of Static Pressure of Propeller Fan Between First Embodiment and Comparative Example The change in static pressure of the propeller fan between the first embodiment and the comparative example will be described with reference to FIGS. 11 to 13. FIG. 11 is an air volume-input (input power) curve diagram. FIG. 12 is an air volume-rotation speed curve diagram. FIG. 13 is an air volume-static pressure curve diagram. FIGS. 11 and 12 illustrate preconditions for comparing the static pressure of the propeller fan between the first embodiment and the comparative example.

FIG. 11 illustrates that the input (input power) is W1 [W] when the air volume of the propeller fan is Q01 [$m^3$/h] and the input (input power) is W2 [W] when the air volume of the propeller fan is Q02 [$m^3$/h]. FIG. 12 illustrates that the rotation speed is RF1 [rpm] when the air volume of the propeller fan is Q01 [$m^3$/h] and the rotation speed is RF2 [rpm] when the air volume of the propeller fan is Q02 [$m^3$/h]. That is, the first embodiment and the comparative example illustrate that the input (input power) and the rotation speed are the same if the air volume is the same.

Here, as illustrated in FIG. 13, in the comparative example, the static pressure is P1 [Pa] when the air volume of the propeller fan is Q01 [$m^3$/h], whereas in the first embodiment, the static pressure is a higher value than P1 [Pa] when the air volume of the propeller fan is Q01 [$m^3$/h], and the static pressure is increased to be higher than P1. Further, in the comparative example, the static pressure is P2 [Pa] when the air volume of the propeller fan is Q02 [$m^3$/h], whereas in the first embodiment, the static pressure is a higher value than P2 [Pa] when the air volume of the propeller fan is Q02 [$m^3$/h], and the static pressure is increased to be higher than P2.

That is, if the static pressure is the same at P1 [Pa], the air volume of the propeller fan according to the comparative example is Q01 [$m^3$/h], and the air volume of the propeller fan according to the first embodiment is Q11 [$m^3$/h], which is increased from Q01 [$m^3$/h] to Q11 [$m^3$/h]. Further, if the static pressure is the same at P2 [Pa], the air volume of the propeller fan according to the comparative example is Q02 [$m^3$/h], and the air volume of the propeller fan according to the first embodiment is Q12 [$m^3$/h], which is increased from Q02 [$m^3$/h] to Q12 [$m^3$/h]. Conversely, in the first embodiment, even in a case where the static pressure is higher than in the comparative example, the same air volume as in the comparative example can be secured. That is, from FIG. 13, it can be said that the air volume of the propeller fan 5 can be increased according to the first embodiment.

In the first embodiment described above, the blade 12 has a shape of branching into the blade elements 12-11, 12-12, and 12-13 from the outer peripheral portion 12*b* to the inner peripheral portion 12*a*. The blade elements 12-11, 12-12, and 12-13 are connected such that the bases 12-11*a*, 12-12*a*, and 12-13*a* form a row around the hub 11. The blade element 12-11 has the extension portion 12-11B having a triangular or convex shape in the vicinity of the branch point 12*p* of the blade elements 12-11 and 12-12 on the trailing edge 12-11-1 side on the downstream side of the hub 11 in the rotational direction.

Therefore, since the extension portion 12-11B suppresses the airflow from being deflected due to the centrifugal force by the rotation of the propeller fan 5, the occurrence of a surging phenomenon can be prevented. Further, by arranging the blade elements 12-12 and 12-13 to overlap with the rotation orbits of the blade elements 12-11 and 12-12 with the hub 11 as the rotation center, the airflow flowing along the position of the blade surface separated from the extension portion 12-11B is affected by the next blade element 12-12. Thereby, the force of the blade 12 is exerted even on the airflow that could not exert the force of the blade 12 in the related art, and the air volume of the propeller fan 5 can be increased. That is, according to the first embodiment, it is possible to increase the air volume of a propeller fan while suppressing the occurrence of a surging phenomenon.

Modification of First Embodiment (1) In the first embodiment, the blade element. 12-11 has the extension portion 12-11B on the trailing edge 12-11-1. However, the present invention is not limited thereto, and the blade element 12-11 may not have the extension portion 12-11B on the trailing edge 12-11-1 and the blade element 12-12 may have the same extension portion as the extension portion 12-11B, on the trailing edge 12-12-1. Alternatively, the blade element 12-11 may have the extension portion 12-11B on the trailing edge 12-11-1 and the blade element 12-12 may have the same extension portion as the extension portion 12-11B, on the trailing edge 12-12-1.

(2) In the first embodiment, the blade element 12-11 has the extension portion 12-11B on the trailing edge 12-11-1. However, the present invention is not limited thereto, and the blade element 12-12 may have the same extension portion as the extension portion 12-11B, on the leading edge 12-12-2. Alternatively, the blade element 12-11 may have the extension portion 12-11B on the trailing edge 12-11-1 and the blade element 12-12 may have the same extension portion as the extension portion 12-11B, on the leading edge 12-12-2.

Similarly, the blade element 12-12 may have the same extension portion as the extension portion 12-11B, on the trailing edge 12-12-1, and the blade element 12-13 may have the same extension portion as the extension portion 12-11B, on the leading edge 12-13-2.

Alternatively, the blade element 12-11 may have the extension portion 12-11B on the trailing edge 12-11-1, the blade element 12-12 may have the same extension portion as the extension portion 12-11B, on the leading edge 12-12-2, the blade element 12-12 may have the same extension portion as the extension portion 12-11B, on the trailing edge 12-12-1, and the blade element 12-13 may have the same extension portion as the extension portion 12-11B, on the leading edge 12-13-2.

SECOND EMBODIMENT

Figure 14:
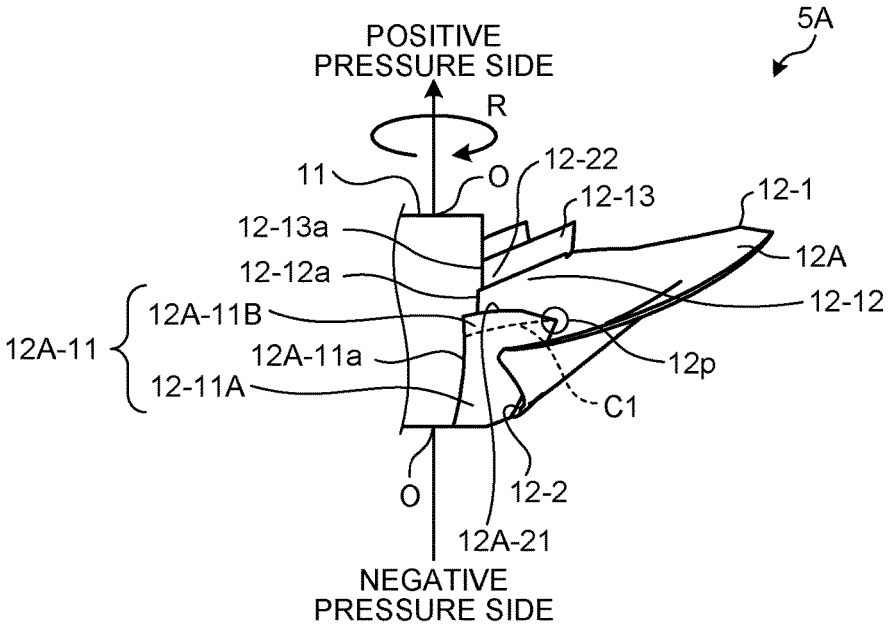
FIG. 14 is a side view illustrating one of blades of a propeller fan according to a second embodiment.

FIG. 14 is a side view illustrating one of blades of a propeller fan according to a second embodiment. A blade element 12A-11 of a blade 12A of a propeller fan 5A according to the second embodiment is connected to the hub 11 with a base 12A-11*a* as a connection part. Further, in the blade 12A, the extension portion 12A-11B of the blade element 12A-11 has a substantially trapezoidal shape with the boundary C1 as the base.

The height of the extension portion. 12A-11B from the boundary C1 in the positive pressure side of the hub 11 gradually increases from the one end of the boundary C1 in the vicinity of the branch point 12*p* of the blade element 12A-11 and the blade element 12-12, and the height thereof from the boundary C1 in the positive pressure side of the hub 11 is substantially constant up to the connection point with the hub 11 after a point where the extension portion 12A-11B becomes highest from the boundary C1 in the positive pressure side of the hub 11.

That is, similarly to the extension portion 12-11B of the first embodiment, the extension portion 12A-11B of the second embodiment has a shape in which the height of the extension portion 12A-11B from the boundary C1 in the positive pressure side of the hub 11 gradually increases, in the vicinity of the branch point 12*p* of the blade element 12A-11 and the blade element 12-12. In other words, the entire leading edge 12-12-2 of the blade element 12-12 overlaps with the rotation orbit of the extension portion 12A-11B with the hub 11 as the rotation center. Therefore, since the outer end of the extension portion 12A-11B is positioned at the branch point 12*p*, during the operation of the air conditioner with a high load or at a high speed, the airflow flowing from the hole 12A-21 along the blade surface of the blade element 12-12 (airflow inclined in the radial direction due to the influence of centrifugal force in particular) is less likely to become a ventilation resistance, and part of this airflow escapes to the hole 12A-21 through a notched portion so that the load on the outer peripheral blade surface of the blade element 12-12 is reduced and an increase in input power supplied to the fan motor (not illustrated) to drive the propeller fan 5 can be suppressed.

Although the embodiments have been described above, the technology disclosed in the present application is not limited by the above-described contents. Further, the above-described components include those that can be easily assumed by those skilled in the art, those that are substantially the same, and those that are in a so-called equivalent range. Further, the above-described components can be appropriately combined. Furthermore, at least one of various omissions, substitutions, and changes of the components can be performed without departing from the spirit of the embodiment.

REFERENCE SIGNS LIST

1 OUTDOOR. UNIT
3 COMPRESSOR
4 HEAT EXCHANGER
5, 5A PROPELLER FAN
6 HOUSING
6*a* SIDE SURFACE
6*b* FRONT SURFACE
6*c* REAR SURFACE
7 INLET
8 OUTLET
11 HUB
11*a* SIDE SURFACE
12, 12A BLADE
12*a* INNER PERIPHERAL PORTION
12*b* OUTER PERIPHERAL PORTION
12*p* BRANCH POINT
12-11, 12-12, 12-13, 12A-11 BLADE ELEMENT
12-21, 12A-21, 12-22 HOLE
12-11*a*, 12A-11*a*, 12-12*a*, 12-13*a* BASE
12-11A BASE PORTION
12-11B, 12A-11B EXTENSION PORTION
12-1, 12-11-1, 12-12-1, 12-13-1 TRAILING EDGE

The invention claimed is:

1. A propeller fan comprising:

a hub having a side surface around a central axis; and a plurality of blades provided to the side surface, wherein the blade has, in a portion from a base connected to the hub to an outer periphery, an inner peripheral portion positioned on the base side and an outer peripheral portion positioned on the outer peripheral side, and has a plurality of blade elements branching on a way from the outer peripheral portion to the inner peripheral portion, the plurality of blade elements have a trailing edge on a downstream side of rotation with the central axis as a rotation center, and a leading edge on an upstream side of the rotation, are connected to the side surface at a pitch angle with respect to the central axis, and form a hole which is a flow path for airflow, between the adjacent blade elements, the plurality of blade elements have a first blade element on the upstream side of the rotation and a second blade element on the downstream side of the rotation to be adjacent to the first blade element which branch at a branch point on the way from the outer peripheral portion to the inner peripheral portion, and include an extension portion as a part of the first blade element, on the trailing edge of the first blade element from the branch point to the side surface, and at least a part of the leading edge of the second blade element overlaps with a rotation orbit of the extension portion with the central axis as the rotation center.

2. The propeller fan according to claim 1, wherein the entire leading edge of the second blade element overlaps with the rotation orbit of the extension portion with the central axis as the rotation center.

3. The propeller fan according to claim 1, wherein the plurality of blade elements are connected to positions of the side surface in different directions with respect to the central axis.

4. The propeller fan according to claim 1, wherein the extension portion has a portion having a shape that allows an airflow flowing along a blade surface of the blade element to escape to the flow path, at the branch point.

* * * * *